United States Patent [19]

Roth

[11] Patent Number: 4,910,808

[45] Date of Patent: Mar. 27, 1990

[54] DEODORIZER DISPENSER FOR A GARBAGE GRINDER DISPOSER

[76] Inventor: Earl M. Roth, 3163 Sweetwater Springs Rd., #240, Spring Valley, Calif. 92078

[21] Appl. No.: 322,915

[22] Filed: Mar. 14, 1989

[51] Int. Cl.[4] ..... E03D 9/00

[52] U.S. Cl. ..... 4/222; 4/654; 222/182; 222/183

[58] Field of Search ..... 4/222, 654; 222/182, 222/183, 529, 645

[56] References Cited

U.S. PATENT DOCUMENTS

| | | | |
|---|---|---|---|
| 1,498,823 | 6/1924 | Van Meter | 4/222 |
| 2,665,824 | 1/1954 | Anderson | 222/183 |
| 3,150,800 | 9/1964 | Weber | 222/182 |
| 3,157,317 | 11/1964 | Ramsbotham | 222/183 |
| 4,496,081 | 1/1985 | Farrey | 222/529 X |

FOREIGN PATENT DOCUMENTS

| | | | |
|---|---|---|---|
| 2249816 | 5/1975 | France | 222/183 |
| 2551787 | 3/1985 | France | 4/222 |

*Primary Examiner*—Charles E. Phillips
*Attorney, Agent, or Firm*—Frank D. Gilliam

[57] ABSTRACT

The invention is directed to a dispenser for dispensing sanitizer and/or deodorizer chemical from a pressurized container into the inside of a grinder type garbage disposer. The dispensing device mounts in a convenient location adjacent to the grinding garbage disposer it is intended to serve and also at a convenient location for the person who uses the garbage disposer. The device comprises a canister with a substantially closed bottom surface and a hollow inner area enclosed by a selectively and translatable removable lid. A small diameter tube extends from the nozzle of a pressurized container of deodorant through a small opening in the substantially closed bottom into an area below the mouth of the grinder garbage disposer. For activation of the device the top is translated downward against the valve of the pressurized container causing sanitize and/or deodorant chemical to escape the container flow through the small diameter tube into the garbage disposer. Thusly the disposer is sanitized and/or deodorized.

3 Claims, 1 Drawing Sheet

DEODORIZER DISPENSER FOR A GARBAGE GRINDER DISPOSER

BACKGROUND OF THE INVENTION

The invention is directed to sanitizing and deodorizing and more particularly to the sanitizing and/or deodorizing of in home sink mounted grinder type garbage disposer.

Modernly, most new homes come equipped with an in sink mounted electric grinder garbage disposer. This devices operate very economically and are convenient to the house wife as a means for disposing of certain selected garbage with out having to leave the kitchen and travel to an out-of-doors trash can or the like at an inconvenient time. Also being able to dispose of the ground up garbage through the sewer system provides a more sanitary condition around the home.

Although garbage disposers have been in use in the majority of modern homes, sanitizing and deodorizing of the disposer has been done in a haphazard manner or not at all. Some household garbage disposers have never been sanitized and/or deodorized since put into use, others have been deodorized when the odor therefrom become unbearable and others go on with the odor unnoticed.

There would be a large demand for an in house grinder disposer sanitation and deodorizing system the would by the mere depressing of a convenient container periodically completely sanitize and deodorize the home garbage disposer.

There has not been a convenient means to sanitize or deodorize a household grinder type garbage disposer until the emergence of the present invention.

SUMMARY OF THE INVENTION

The invention comprises a convenient attachment means for mounting of a pressurized can of sanitizer and/or deodorizer on the kitchen sink adjacent to the mouth of the garbage disposer which when downwardly depressed releases a small amount of the contents of the can directly into the disposer.

An base attachment is secured to the sink surface with a small opening through the sink surface. The base may take the form of a top of the sink breather for a automatic dishwasher, but is not intended to be so limited. The base is fixedly attached to the sink by any convenient means such as, threads and nut, screws, or the like. An open canister removably attaches to the base by means of threads, a bayonet connection or any other convenient manner. The inside of the canister has a rib extending the longitudinal length of the canister. The rib has an elongated channel extending its entire length the purpose of which will be hereinafter explained. A translatable lid encloses the top open end of the canister.

In operation, a pressurized container of a sanitizer and/or deodorizer is placed within the canister. A small diameter tube extends from the nozzle of the pressurized container down the elongated channel through the base, sink top and into the disposer through a small aperture in the upper wall thereof. When sanitizing and/or deodorizing is desired the top of the canister is pushed downward against the release valve of the pressurized container whereby liquid from the container is fed into the garbage disposer. This procedure can be repeated as required.

An object of this invention is top provide a convenient means for sanitizing and/or deodorizing a household grinder garbage disposer.

Another object of this invention is to provide a convenient means for attaching a commercially available chemical sanitizer and/or deodorizer pressurized container to the kitchen sink for supplying the contents into a garbage disposer.

Other objects, features and attendant advantages of the present invention will become apparent from a consideration of the following detailed description of a specific embodiment thereof, especially when taken in conjunction with the accompanying drawings in which:

BRIEF DESCRIPTION OF THE DRAWING FIGURES

DETAILED DESCRIPTION OF THE PREFERRED EMBODIMENT

Figure 1:
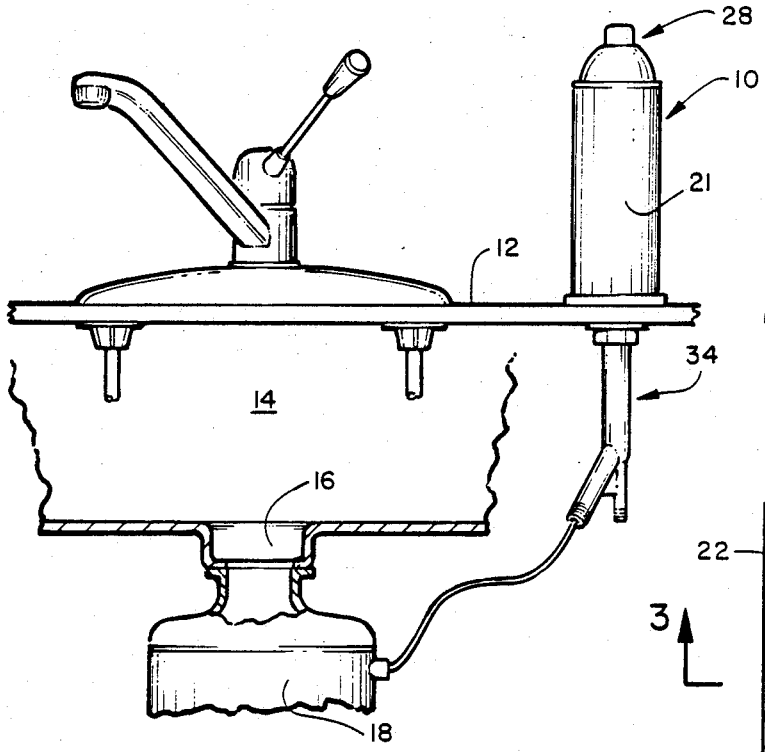
FIG. 1 is a cutaway partial showing of the device of the invention mounted on the upper surface of a kitchen sink adjacent to a conventional grinder garbage disposer.
Figure 2:
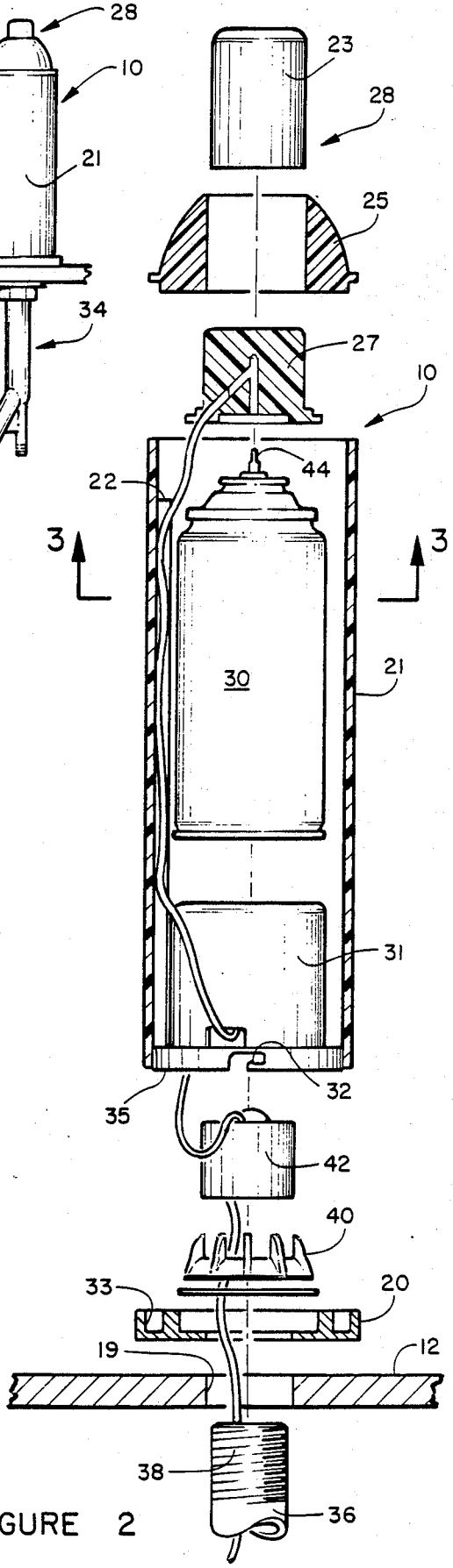
FIG. 2 is an exploded showing of the invention and its mounting means.

Referring now to the drawing Figures and specifically to FIG. 1 and 2, the invention is directed to dispensing device 10 which conveniently attaches to the upper surface 12 of a household sink 14 which is adjacent to and drains into the mouth 16 of a garbage disposer 18 for selectively dispensing sanitizer and/or deodorizer under pressure into an area adjacent to the mouth of the disposer.

Figure 3:
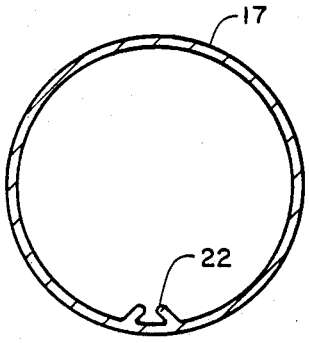
FIG. 3 is a showing taken along line 3—3 of FIG. 2 with the canister removed for clarity.

The dispensing device 10 comprises a base member 20 that attaches to the sink surface adjacent to the mouth 16 of the disposer 18 and has at least an.aperture 19 through the sink surface 12; an open cylinder 21 removably attaches to the base member 20. The open cylinder has includes a rib 22, see drawing FIG. 3, which extends substantially the length of the canister; and a lid assembly 28 comprising a translatable cap 23, a spacer 25 and a dispensing cap 27 which encloses the open top end surface of the open cylinder. The decorative cap translates within and the spacer 25 and relative thereto.

The open cylinder is designed to receive one of a variety of different sized pressurized containers 30 of commercially available sanitizing and/or deodorizing chemical. The container of chemical 30 is inserted into the open end the cylinder 21, and is spaced from the inner wall of the cylinder by the rib 22, see FIG. 3, and rests on the upper surface of a hollow base member 31. The hollow base member can be the sink top lower portion of a conventional dishwasher breather vent the top of which is used as translatable cap 23 or can be fabricated just for the purpose of this invention. The hollow base member is secured within the canister 21 by any convenient manner such as adhesive or the like. The base member 31 fits into grove 33 and is locked to the base member via a bayonet connector on the inner grove wall, not shown, which mates with opening 32 of the canister bottom 35. The base member is attached to the sink top, for example, by means of a dishwasher vent pipe assembly 34 or the like. The assembly 34 comprises a pipe 36 with a threaded end 38 which is threadedly attached to a nut 40 positioned on the top of the sink surface. A washer 42 is positioned between the base member 20 and the lower surface of the nut 40. A cap 42 is threadedly attached to the distal end of the pipe 36. The assembly including the nut, cap and washer fit within the hollow base member 31, see FIG. 1. The lid 27 rests upon the container release valve 44. A small diameter tube 34 extends from the liquid opening in the release valve 32 through cap 27, through the length of the canister, through the hollow base member, through aperture 19, through the threaded cap, into and through the pipe of the dishwasher vent assembly or the like, through the wall of the disposer housing below the mouth and into the disposer.

When it is desirable to sanitize and/or deodorize the garbage disposer the cap 23 is depressed toward the base member 20 which presses the release valve 44 downward into a valve open position whereby chemical under pressure from the container 30 is released and travels the length of the tube 34 into the garbage disposer.

Releasing the downward pressure of the lid closes the valve terminating the flow of chemical. The above action can be repeated when ever necessary.

When the container is empty the top assembly 28 is removed from the container and the spent container can be removed and replace with a new container and the cap assembly is replaced.

It should be understood although the embodiment of the invention is directed to use with a grinder type garbage disposer the invention will work equally as well in the absence of a disposer to sanitize and/or deodorize the trap or the like in a drain system.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by letters patent of the United States is:

1. A dispensing device in combination with a sink top for dispensing a sanitizing and/or deodorizing chemical into a drain conduit comprising:

a base member attached to said sink top adjacent to said drain conduit, said base member and said sink top having at least a small aperture therethrough;

an open cylinder removably attached to said base member;

a translatable cap and spacer for closing the upper end of said cylinder;

a pressurized container of said chemical positioned within said cylinder, said container having a valve member depressible to an open condition for dispensing of said chemical from said container;

said open cylinder includes a rib member on the inner surface thereof which extends substantially the length thereof for spacing said pressurized container from at least a portion of the wall of said canister and guiding said tube through said canister;

an aperture through said drain conduit near an opening into said drain conduit; and a tube extending from said valve through said base, sink top and drain apertures into said drain conduit whereby when said cap is translated toward said base member said valve is depressed and chemical is dispensed from said valve through said tube into said drain conduit.

2. The invention as defined in claim 1 wherein said rib is configured to accept said tube therein.

3. The inventions defined in claim 1 wherein said drain conduit includes a garbage disposer.

* * * * *